US010583319B2

(12) United States Patent
Bear et al.

(10) Patent No.: US 10,583,319 B2
(45) Date of Patent: Mar. 10, 2020

(54) FREE WEIGHT BAR STABILIZER

(71) Applicants: Morris R. Bear, Centerville, IA (US); Patrick A. Morris, Albion, IA (US)

(72) Inventors: Morris R. Bear, Centerville, IA (US); Patrick A. Morris, Albion, IA (US)

( * ) Notice: Subject to any disclaimer, the term of this patent is extended or adjusted under 35 U.S.C. 154(b) by 128 days.

(21) Appl. No.: 15/856,230

(22) Filed: Dec. 28, 2017

(65) Prior Publication Data

US 2019/0201735 A1 Jul. 4, 2019

(51) Int. Cl.

| | |
|---|---|
| ***A63B 21/078*** | (2006.01) |
| ***A63B 21/00*** | (2006.01) |
| ***A63B 21/075*** | (2006.01) |
| ***A63B 21/072*** | (2006.01) |
| *A63B 1/00* | (2006.01) |

(52) U.S. Cl.

CPC ..... *A63B 21/0783* (2015.10); *A63B 21/154* (2013.01); *A63B 21/075* (2013.01); *A63B 21/0724* (2013.01); *A63B 2225/093* (2013.01)

(58) Field of Classification Search

CPC ..... A63B 21/0615; A63B 21/078; A63B 21/0622; A63B 21/0783; A63B 21/154; A63B 2225/093; A63B 21/0724; A63B 21/075; A63B 21/159; A63B 21/4035; A63B 21/4033; A63B 21/06; A63B 21/4045; A63B 21/4047; A63B 21/4049; A63B 22/0046; A63B 23/035; A63B 23/03558; A63B 22/0002; A63B 23/12; A63B 23/00; A63B 21/0004; A63B 32/072; A63B 22/20; A63B 21/072; A63B 21/08

See application file for complete search history.

(56) References Cited

U.S. PATENT DOCUMENTS 4,357,010 A * 11/1982 Telle ..... A63B 21/00072 482/113
4,406,452 A * 9/1983 Lapcevic ..... A63B 21/0615 482/104

(Continued)

*Primary Examiner* — Sundhara M Ganesan
*Assistant Examiner* — Shila Jalalzadeh Abyaneh

(57) ABSTRACT

A free weight bar stabilizer, to be used with a standard size bar and attached barbell plates. The stabilizer includes a beam pivotally attached to a frame at a pivot point so that it is angularly movable in an arc between a raised position and a lowered position, and a carriage attached to the beam so that it is linearly movable radially out from the pivot point between a retracted position and an extended position. The carriage includes spaced distal arms with attachment points for attaching the bar to support its opposing ends. The bar is thus freely movable within an envelope defined by the ranges of the simultaneous angular movement of the beam and the linear movement of the attachment points on the carriage. The free weight bar stabilizer may also include a carriage counterweight that simultaneously moves on the beam in the opposite direction of the carriage to counterbalance the weight of the carriage, so it does not add to the quantity of the weight being lifted and reduce push and pull of the carriage. Further, the bar stabilizer may include an assisting weight mechanism to assist when working heavy negatives, by providing a counterweight to reduce the actual weight being lifted at a predetermined point as the beam moves toward the lowered position.

16 Claims, 6 Drawing Sheets

(56) References Cited

U.S. PATENT DOCUMENTS 4,746,115 A * 5/1988 Lahman ..... A63B 21/00072 482/113
4,858,915 A * 8/1989 Szabo ..... A63B 21/00072 482/97
5,108,095 A * 4/1992 Nichols ..... A63B 21/0615 482/137
5,116,297 A * 5/1992 Stonecipher ..... A63B 21/0615 482/137
5,217,422 A * 6/1993 Domzalski ..... A63B 21/154 482/100
6,482,139 B1 * 11/2002 Haag ..... A63B 21/0552 482/121
7,104,936 B2 * 9/2006 Karlstrom ..... A63B 21/0083 482/112
7,462,141 B1 * 12/2008 Raboin ..... A63B 21/225 482/110
7,488,277 B1 * 2/2009 Knapp ..... A63B 21/078 482/104
8,172,731 B1 * 5/2012 Bredda ..... A63B 21/00065 482/94
8,740,760 B2 * 6/2014 York ..... A63B 21/078 482/104
9,511,258 B2 * 12/2016 Hoole ..... A63B 23/1236
2005/0148445 A1 * 7/2005 Carle ..... A63B 21/0615 482/97
2006/0040800 A1 * 2/2006 Slyter ..... A63B 21/00181 482/94
2009/0192026 A1 * 7/2009 Mason ..... A63B 21/0615 482/97
2014/0256516 A1 * 9/2014 Calderone ..... A61B 5/103 482/98
2016/0114205 A1 * 4/2016 Giunchi ..... A63B 71/0054 482/127

* cited by examiner

FREE WEIGHT BAR STABILIZER

BACKGROUND OF INVENTION

Field of the Invention

The present invention relates to the field of free weight training devices, and more particularly to a device that stabilizes the free weight bar when being used in lifting and exercising.

Description of Related Art

Free weight training using a bar, with attached barbell plates, is the most desirable way to increase strength with all types of athletes, at all levels. A major challenge in working with free weights is to keep the bar stable while being used, particularly when loaded with numerous barbell plates. The bar tends to tip from side-to-side, and roll down the neck when performing certain routines, such as the "good morning". To compensate for unintended bar movement, the lifter must fight the bar to keep the loaded bar under control, and preferably will have other individuals act as "spotters" to prevent the bar from moving out of control, and possibly causing injuries.

Frequently, lifters work 'heavy negatives' to allow them to gradually work up to a heavier weight lifted. Sometimes, the lifter works with a desired weight through an initial portion of the routine, and then uses a lighter weight at a later portion of the routine. The lighter weight portion of the routine is then gradually reduced until the desired heavier weight is applied during the entire routine.

Other than chains or binds, there are no known devices available in the prior art to assist the lifter for incrementally adjusting the load during the performance of a routine.

As a consequence of the foregoing situation there has existed a longstanding need for a new and improved device for stabilizing a free weight bar and the provision of such a construction is a stated objective of the present invention.

BRIEF SUMMARY OF THE INVENTION

Briefly stated, the present invention provides a free weight bar stabilizer, to be used with a standard size bar and attached barbell plates. The stabilizer includes beams pivotally attached to a frame at a pivot point so that it is angularly movable in an arc between a raised position and a lowered position, and a carriage attached to the beams so that it is linearly movable radially out from the pivot point between a retracted position and an extended position. The carriage includes spaced distal arms with attachment points for attaching the bar to support its opposing ends. The bar is thus freely movable within an envelope defined by the ranges of the simultaneous angular movement of the beam and the linear movement of the attachment points on the carriage. The free weight bar stabilizer may also include a carriage counterweight that simultaneously moves on the beam in the opposite direction of the carriage to counterbalance the weight of the carriage, so it does not add to the quantity of the weight being lifted and stops pull or push of the carriage in or out. Further, the bar stabilizer may include an assisting weight mechanism to assist when working heavy negatives, by providing a counterweight to reduce the actual weight being lifted at a predetermined point, as the beam moves toward the lowered position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings wherein.

DETAILED DESCRIPTION OF THE INVENTION

Figure 1:
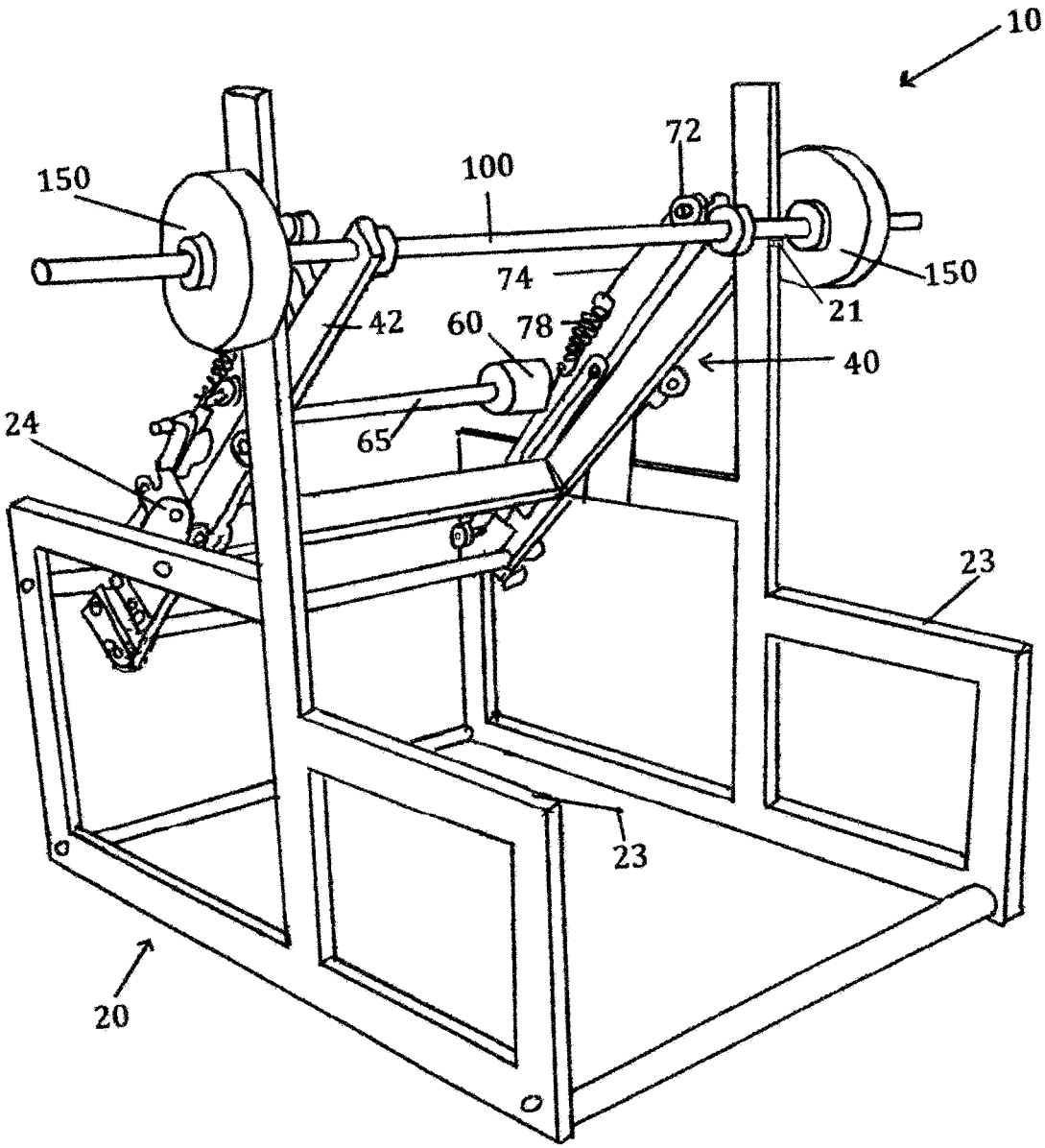
FIG. 1 is a perspective view of the free weight bar stabilizer of the present invention, showing the bar in a raised position supported on a vertical frame member.
Figure 2:
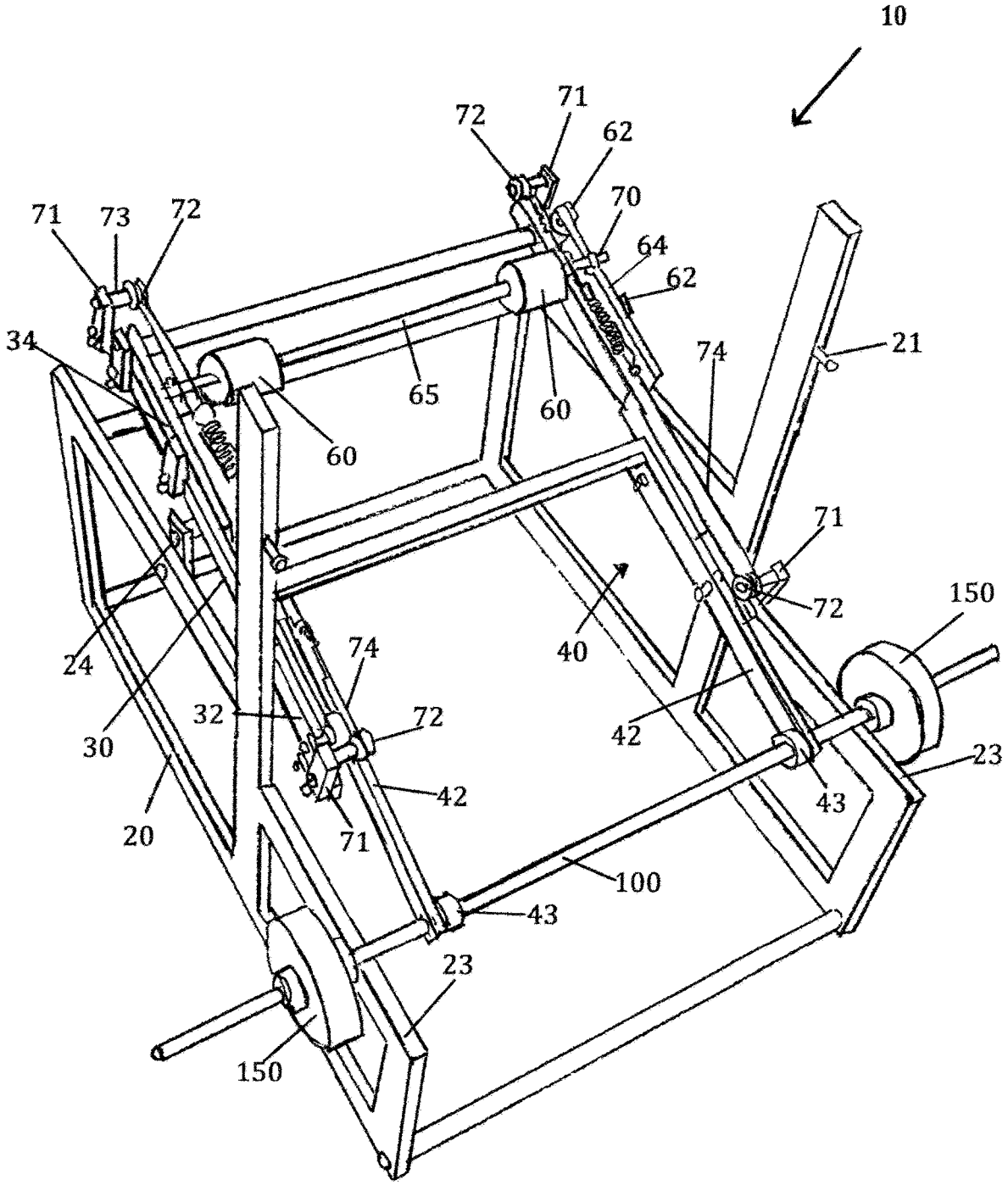
FIG. 2 is a perspective view similar to FIG. 1, but showing the bar in a lowered position resting on the spotting rail.

As can be seen by the reference to the drawings, and particularly to FIGS. 1 and 2, the free weight bar stabilizer that forms the basis of the present invention is designated generally by the reference number 10.

The bar stabilizer 10 includes a frame 20, a pair of main beams 30 pivotally attached to the frame 20, and a moveable carriage 40 supported on a front section 32 of the beams 30. The stabilizer 10 shown in the drawings further includes a carriage counterweight 60 supported on a rear section 34 of the beams 30; and also includes an assisting weight mechanism 80. (not show in FIGS. 1-2)

Figure 3:
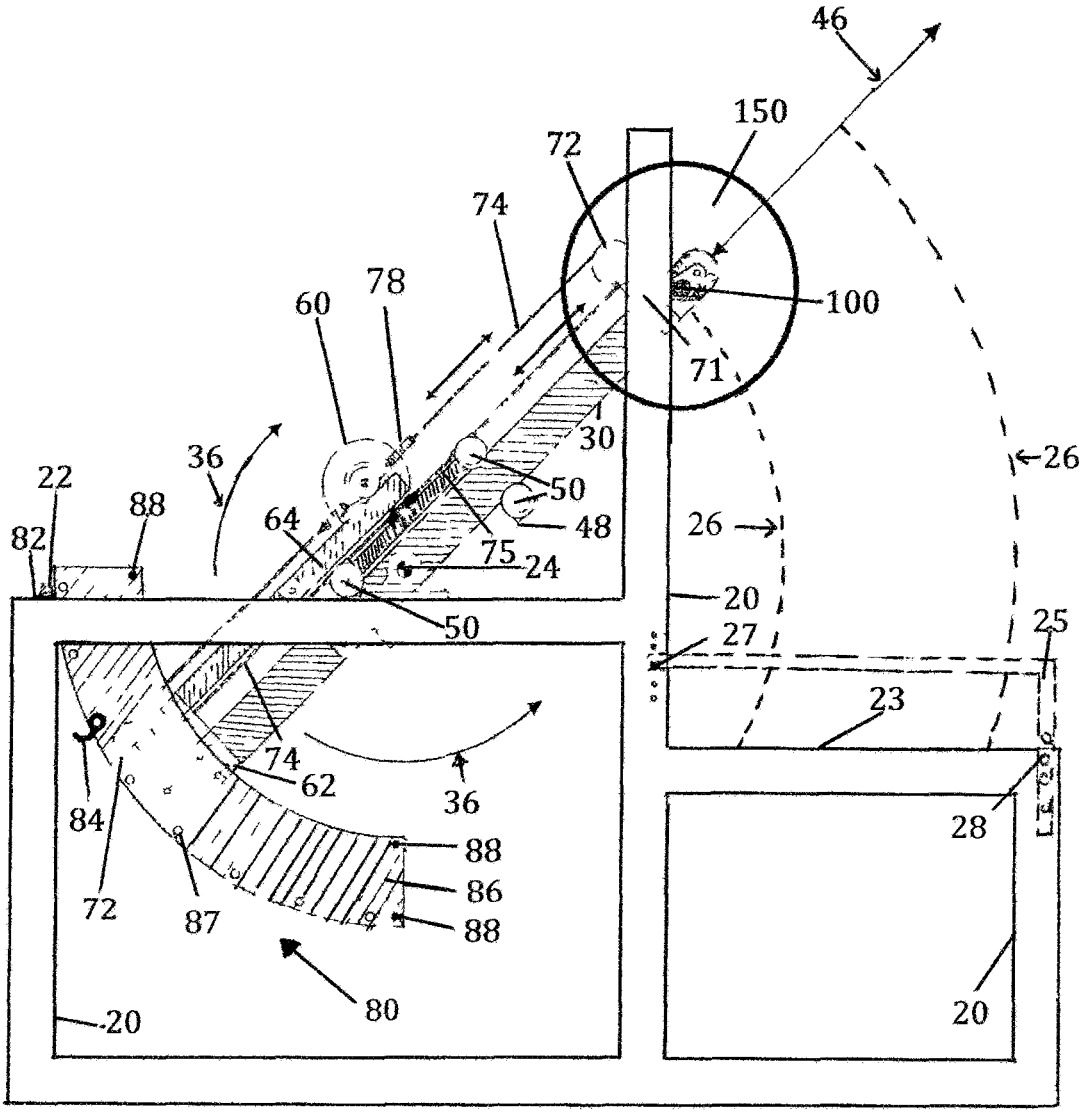
FIG. 3 is a side elevation view of the bar stabilizer.
Figure 4:
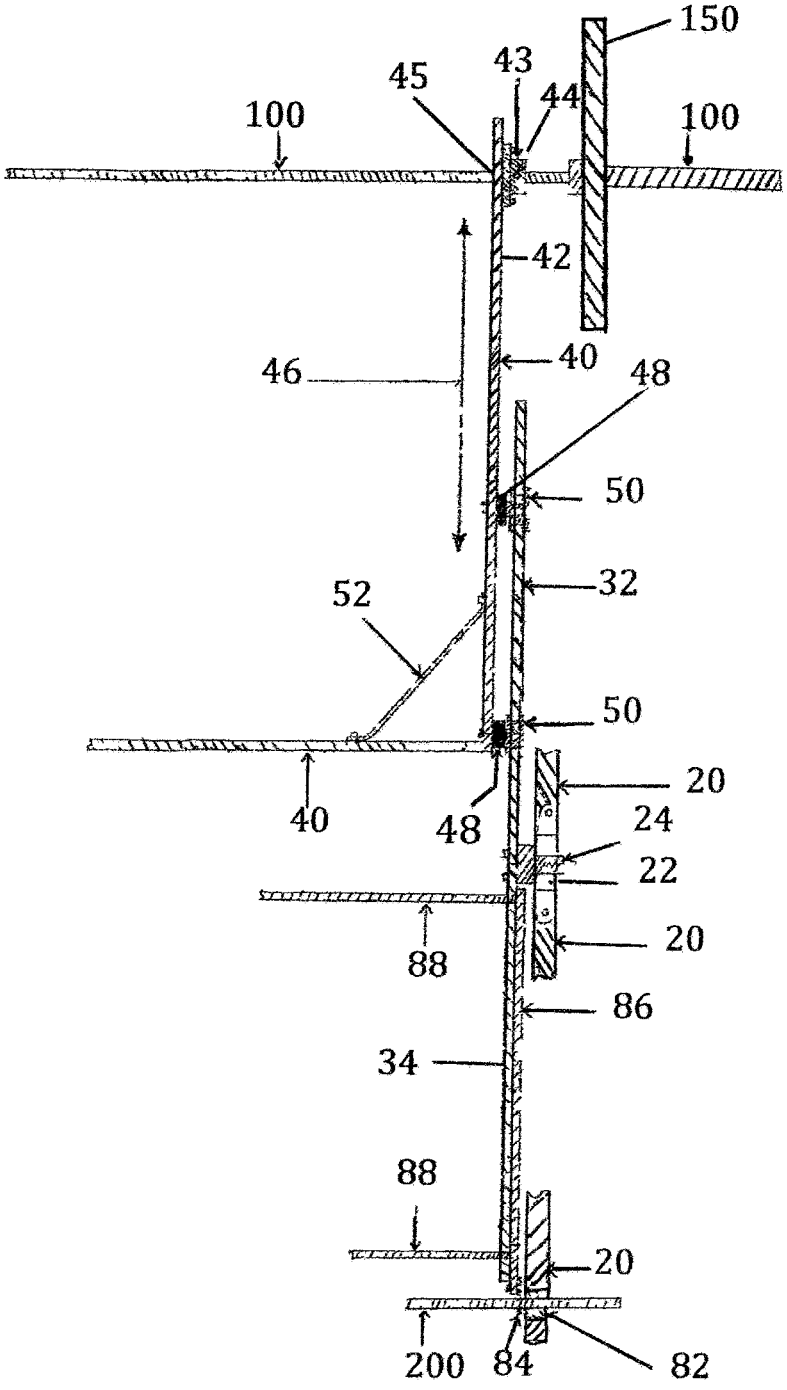
FIG. 4 is a partial plan view, with structure eliminated to clearly show the carriage supported on the front section of the main beams.
Figure 5:
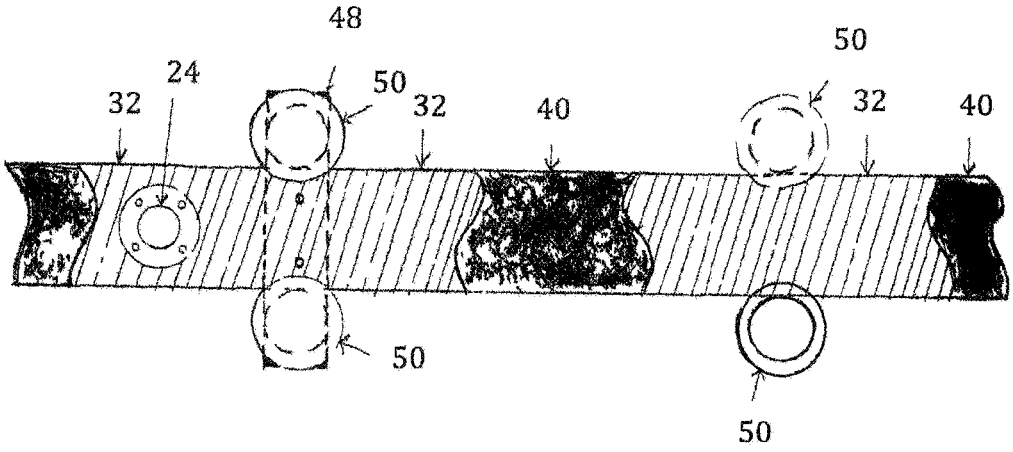
FIG. 5 is an enlarged partial side elevational view showing the front section of the beam carrying the roller assembly of the carriage.

As shown in FIGS. 3 and 4, the frame 20, at each lateral side, supports a bearing 22 that receives a pivot shaft 24 disposed to rotate about a horizontal axis. The pivot shafts 24 are positioned on each side of the frame 20 at an elevation of about thirty-six inches, which approximates the position of the hip joint of an average person. A beam 30 is pivotally attached to each of the shafts 24 with a front section 32 and a rear sections 34 located fore and aft of the shafts 24, respectively. The beams 30 are disposed parallel to each other and move between a raised and lowered position in an arc shown by the directional arrow 36.

A linearly movable carriage 40 is received on the front section 32 of each of the beams 30. The carriage 40 includes horizontally spaced arms 42 that each have a bearing 43, with a set screw 44, attached adjacent a bar receiving opening 45 at the distal end of the arms 42. A roller assembly, that includes a roller bracket 48 carrying four rollers 50, is attached to and movably interconnects the front section 32 of each of the beams 30 and a rear portion of the carriage 40. A carriage brace 52 assists and keeping the carriage arms 42 parallel to the front section 32 of the beams 30. The carriage 40 is linearly movable radially out from the beams 30 between a retracted and extended position shown by the directional arrow 46. The combined angular range of motion of the beam 30, and the linear range of motion of the bar receiving opening 45 on each of the carriage arms 42, defines the envelope of operation 26 of the free weight stabilizer 10.

In use, a standard Olympic bar 100 is placed through the opening 45 and the bearing set screws 44 are tightened. The desired weight is added by attaching and securing barbell plates 150 at the ends of the bar 100. The starting height of the bar 100 may be anywhere in the envelope of operation 26.

FIG. 1 shows the bar 100 on a bar rest 21 attached to a vertical member of the frame 20 at a starting height of about fifty-four inches, which approximates the position of the shoulders and neck of the average lifter. The envelope of operation 26 shown has an upper limit defined by the location of the bar rest 21, and a lower limit defined by the spotting rail 23 that extends out from the front of the frame 20. If using the spotting rail 25 that is adjustable using pins 27 and holes 28, as shown in dashed lines, the envelope of operation 26 would be reduced.

It may be desirable to compensate for the weight of the carriage 40 that is acting on the lifter by providing a counterweight 60 that would balance the weight of the front and rear sections 32, 34 of the beam 30. This could result in the lifter experiencing only the weight of the bar 100 and the attached the barbell plates 150.

Figure 6:
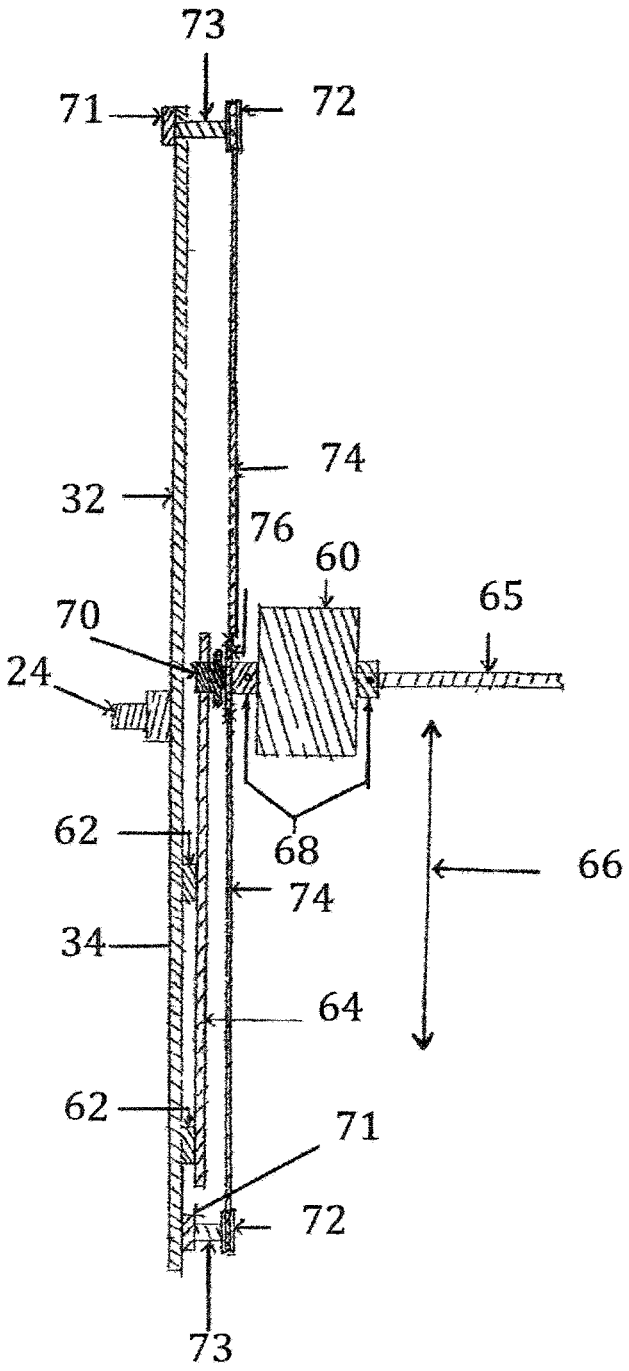
FIG. 6 is a partial plan view, with structure eliminated to clearly show the counterweight supported on the rear section of the main beams, and to show the linkage that interconnects the carriage and the counterweight.

As best shown in FIGS. 3 and 6, brackets 62 support a counterweight track 64 above and parallel to the rear section 34 of each of the beams 30. A shaft 65 extends transversely between the tracks 64, and carries a counterweight 60, secured by lock collars 68, interior of each of the tracks 64. A roller 70 is attached at each end of the shaft 65 to engage the tracks 64. Thus, the counterweights 60 are attached to the rear section 34 of the beams 30, and are moveable between a forward position and a rearward position as indicated by the directional arrow 66. To further refine the balancing of weight on the front and rear sections 32, 34 of the beam 30, a linkage is provided to interconnect the carriage 40 and counterweight 60. Using this linkage, as the carriage 40 moves from its retracted position to its extended position, the counterweight 60 simultaneously moves from its forward position to its rearward position.

Referring again to FIGS. 3 and 6, the linkage includes two pulleys 72, one attached to the front section 32 of the beams 30 and the other attached to the rear section 34 of the beams 30 by a pulley bracket 71 and a standoff 73. A front section of cable 74 has ends attached to an anchor 75 on the carriage 40, and to an anchor 76 on the counterweight 60. The cable 74 is trained over the pulley 72 at the front section 32 of the beams 30. A rear section of cable 74 is also attached to the anchors 75 and 76, and is trained over the pulley 72 at the rear section 34 of the beams 30. Springs 78 keep tension on the cable 74. The movement of the carriage 40 in one direction results in simultaneous movement of the counterweight 60 in the other direction to keep the beam 30 in balance. Thus, the lifter experiences only the weight of the bar 100 and the attached barbell plates 150.

At times it is desirable to change the amount of weight being lifted during the course of an exercise routine. An assisting weight mechanism 80 is provided that has an assisting weight bar rest 82 positioned at the rear of both sides of the frame 20. An assisting weight bar pickup hook 84 is carried on hook plate 86 attached at the rear section 34 of the beams 30. The hook plates 86 are connected by transverse tie bars 88 to keep them properly spaced and stabilized. Each of the hook plates 86 are arcuate in shape, and include a number of openings 87 spaced in an arcuate path along the rear edge of the plates 86. A selected one of the openings 87 on the hook plates 86 is adapted to selectively receive and support a pickup hook 84. Hooks 84, attached at the same elevation on each of opposing plates 86, are disposed to engage and lift and assisting weight bar 200 up from the bar rest 82. When the assist bar 200, with any attached weights, is raised off the rest 82, the total weight picked up becomes a counterweight to the front section 32 of the beams 30 that carries the weight of the main bar 100 and attached barbell plates 150 being lifted. Thus, as the lifter bends down so that the main bar 100 on the carriage 40 moves toward the lowered position, the total weight being lifted is reduced at the predetermined point where the assist bar 200 is engaged by the hooks 84 and is raised. Changing the location of the pickup hooks 84 on the assist plates 86, changes the point where the total weight being lifted is changed.

The free weight bar stabilizer 10 of the present invention is particularly useful as the device for strengthening the posterior muscle chain through the 'good morning' and the 'Zercher' lift routines. Other exercises such as squats, deadlifts, shrugs and various bench routines may also be performed using the bar stabilizer 10. The assisting weight mechanism 80 assists the lifter when working 'heavy negatives', by reducing the weight being lifted at a particular point in a routine, to allow the lifter to gradually work up to a heavier desired weight.

In general, the bar stabilizer 10 allows the bar 100 to follow the lifter throughout the range of the movement within the working envelope of the bar 100. When performing the 'good morning' routine, the stabilizer 10 prevents the bar 100 from tipping from side to side, and also prevents the bar 100 from rolling down the lifter's neck when approaching the lowest point of movement in the routine. Since the bar 100 is completely stabilized, the lifter can achieve the full depth of the routine, and the risk of injury is greatly reduced.

Although only an exemplary embodiment of the invention has been described in the detail above, those skilled in the art will readily appreciate that many modifications are possible without materially departing from the novel teachings and advantages of this invention. Accordingly, all such modifications are intended to be included with the scope of this invention as defined in the following claims.

The invention claimed is:

1. A free weight bar stabilizer, comprising:

a bar with barbell plates attached at opposing ends of the bar;

a frame;

a beam pivotally attached to the frame at a pivot point, and being disposed to pivot about a horizontal axis, the beam being pivotally movable between a raised position and a lowered position;

a carriage movably attached to the beam and being movable between a retracted position and an extended position, the carriage including horizontally spaced arms with points of attachment at their distal ends disposed to selectively receive the bar;

wherein the bar is movable within an envelope defined by the points of attachment wherever the beam moves between its raised and lowered positions, and the carriage moves between its retracted and extended positions;

a carriage counterweight wherein the beam includes a front section forward of the pivot point to which the carriage is attached, and a rear section rearward of the pivot point to which the carriage counterweight is attached;

wherein the carriage counterweight is movably attached to the rear section of the beam, and is movable between a forward position and a rearward position; and a linkage attached to and interconnecting the carriage and the carriage counterweight, wherein as the carriage moves from its retracted position to its extended position, the carriage counterweight simultaneously moves from its forward position to its rearward position.

2. The stabilizer of claim 1, further including an assisting weight bar positioned on the frame, and an assisting weight bar hook operably attached to the rear section of the beam disposed rearward of the pivot point, the assisting weight bar hook being disposed below the assisting weight bar, wherein the assisting weight bar hook engages and lifts the assisting weight bar at a predetermined point as the front section of the beam moves toward its lowered position.

3. The stabilizer of claim 2, further including a hook plate attached to the rear section of the beam and including a plurality of hook receiving points on the plate spaced above and below the beam, wherein the assisting weight bar hook is selectively received at one of the plurality of hook receiving points, and wherein the predetermined point where the hook engages and lifts the assisting weight bar is determined by placement of the hook.

4. The stabilizer of claim 3, wherein the hook plate has an arcuate a shape, and the hook receiving points are spaced in an arcuate path on the hook plate.

5. The stabilizer of claim 1, further including a spotting rail attached to the frame and being disposed at a lower section of the bar envelope.

6. The stabilizer of claim 5, wherein the spotting rail is vertically adjustable.

7. The stabilizer of claim 1, wherein the linkage includes a forward pulley attached to the front section of the beam, a rearward pulley attached to the rear section of the beam, a front cable carried on the forward pulley and being attached to and interconnecting the carriage and the carriage counterweight, and a rear cable carried on the rearward pulley and being attached to and interconnecting the carriage and the carriage counterweight.

8. A free weight bar stabilizer, comprising:

a bar with barbell plates attached at opposing ends of the bar;

a frame;

a beam pivotally attached to the frame at a pivot point, and being disposed to pivot about a horizontal axis, the beam being pivotally movable between a raised position and a lowered position;

a carriage movably attached to the beam and being movable between a retracted position and an extended position, the carriage including horizontally spaced arms with points of attachment at their distal ends disposed to selectively receive the bar;

wherein the bar is movable within an envelope defined by the points of attachment wherever the beam moves between its raised and lowered positions, and the carriage moves between its retracted and extended positions; and an assisting weight bar positioned on the frame, and an assisting weight bar hook operably attached to the rear section of the beam disposed rearward of the pivot point, the hook being disposed below the assisting weight bar, wherein the hook engages and lifts the assisting weight bar at a predetermined point as the front section of the beam moves toward its lowered position.

9. The stabilizer of claim 8, further including a carriage counterweight wherein the beam includes a front section forward of the pivot point to which the carriage is attached, and a rear section rearward of the pivot point to which the carriage counterweight is attached.

10. The stabilizer of claim 9, wherein the carriage counterweight is movably attached to the rear section of the beam, and is movable between a forward position and a rearward position.

11. The stabilizer of claim 10, further including a linkage attached to and interconnecting the carriage and the carriage counterweight, wherein as the carriage moves from its retracted position to its extended position, the carriage counterweight simultaneously moves from its forward position to its rearward position.

12. The stabilizer of claim 11, wherein the linkage includes a forward pulley attached to the front section of the beam, a rearward pulley attached to the rear section of the beam, a front cable carried on the forward pulley and being attached to and interconnecting the carriage and the carriage counterweight, and a rear cable carried on the rearward pulley and being attached to and interconnecting the carriage and the carriage counterweight.

13. The stabilizer of claim 8, further including a hook plate attached to the rear section of the beam and including a plurality of hook receiving points on the plate spaced above and below the beam, wherein the assisting weight bar hook is selectively received at one of the plurality of hook receiving points, and wherein the predetermined point where the assisting weight bar hook engages and lifts the assisting weight bar is determined by placement of the hook.

14. The stabilizer of claim 13, wherein the hook plate has an arcuate shape, and the hook receiving points are spaced in an arcuate path on the hook plate.

15. The stabilizer of claim 14, further including a spotting rail attached to the frame and being disposed at a lower section of the bar envelope.

16. The stabilizer of claim 15, wherein the spotting rail is a vertically adjustable.

* * * * *